US005992692A

United States Patent [19]

Boissay

[11] Patent Number: 5,992,692

[45] Date of Patent: Nov. 30, 1999

[54] BOTTLE FOR DISPENSING A PRODUCT

[75] Inventor: Michel Pierre Boissay, Offranville, France

[73] Assignee: Carnaudmetalbox Sante Beaute, Saint Ouen, France

[21] Appl. No.: 08/875,589

[22] PCT Filed: Mar. 2, 1995

[86] PCT No.: PCT/FR95/00253

§ 371 Date: Oct. 6, 1997

§ 102(e) Date: Oct. 6, 1997

[87] PCT Pub. No.: WO96/23707

PCT Pub. Date: Aug. 8, 1996

[30] Foreign Application Priority Data

Feb. 1, 1995 [FR] France ..... 95 01174

[51] Int. Cl.[6] ..... B67D 5/00

[52] U.S. Cl. ..... 222/83; 222/81; 222/83.5; 222/153.06; 222/153.07; 222/541.2; 222/541.4

[58] Field of Search ..... 222/83, 81, 83.5, 222/88, 153.06, 153.07, 541.2, 541.4; 141/364, 329, 326

[56] References Cited

U.S. PATENT DOCUMENTS

| | | | |
|---|---|---|---|
| 2,698,113 | 12/1954 | Linton | 222/83 |
| 3,029,987 | 4/1962 | Gronemeyer | 222/541.4 |
| 5,642,838 | 7/1997 | Stoody | 222/83 |
| 5,664,705 | 9/1997 | Stolper | 222/541.4 |

FOREIGN PATENT DOCUMENTS

| | | |
|---|---|---|
| 0 293 290 | 11/1988 | European Pat. Off. . |
| 0 304 972 | 3/1989 | European Pat. Off. . |
| 0 590 293 | 6/1994 | European Pat. Off. . |
| 2 236 748 | 1/1975 | France . |
| 2 285 311 | 4/1976 | France . |
| 2 622 795 | 5/1989 | France . |

*Primary Examiner*—David J. Walczak
*Assistant Examiner*—Timothy L. Maust
*Attorney, Agent, or Firm*—Wenderoth, Lind & Ponack, L.L.P.

[57] ABSTRACT

A bottle including a hollow body (12) for containing a product, the body has a first end forming a neck, a transverse tear-off seal (22) for sealing the neck, and a structure (14) for tearing off the seal (22). The tearing structure is axially movable in the neck by a control member between a stand-by position and an operative position in which the seal is ruptured. The seal (22) includes a weakened portion (24) defining therein at least one retractable flap (25A), and a flap hinge portion (25B) between at least two radially outer ends of the weakened portion (24). The tearing structure includes a flap pushing member for engaging a flap region adjacent to the hinge portion (25B). The bottle is suitable for ophthalmological products.

5 Claims, 3 Drawing Sheets

BOTTLE FOR DISPENSING A PRODUCT

BACKGROUND OF THE INVENTION

The present invention relates to a bottle of the type comprising a hollow body intended to contain a product and which has an end forming a neck, a tearable transverse membrane sealing the neck, and means for tearing the membrane. The means can be moved axially in the neck under the control of a manipulating member between a standby position and an active position for tearing the membrane.

When the bottle is used for the first time it is necessary to tear the membrane, and this is generally achieved using a relatively pointed axial element which can be moved in a direction more or less parallel to the axis of the neck in order to allow product to flow through the neck.

In order to be certain that an orifice of sufficient size is formed in the membrane to allow adequate flow of the fluid, it is necessary to insert the pointed element relatively deeply into the neck, and in particular into the body containing the product.

SUMMARY OF THE INVENTION

The purpose of the invention is to provide a bottle that makes it possible to reliably tear the membrane with only a small movement of the means for tearing.

The subject of the invention is therefore a bottle of the aforementioned type, characterized in that the membrane has a weakened region delimiting in the membrane at least one displaceable flap, and a flap-articulation region situated between at least two radially outermost ends of the weakened region. The means of tearing comprises a member for pushing the flaps by resting against a region of the flap that is close to the articulation region.

The bottle according to the invention may have one or more of the following features:

- the weakened region constitutes a star that weakens the membrane, the points of which star delimit, in pairs, in the membrane, flaps the width of which increases radially towards the periphery of the membrane;
- the pushing member ends in a circular edge for tearing the membrane;
- the pushing member is formed of an end piece mounted on the free end of the neck and through which a duct passes longitudinally for the fluid product to flow along, the end piece includes a stem for tearing the membrane and the stem extend into the neck and defines the circular edge at its free end;
- the fluid flow duct ends in the stem at a region the section of which increases progressively towards the edge;
- the body and the end piece comprise means for positioning them in at least two relative axial positions;
- the end piece comprises an axial skirt surrounding the neck, the means for positioning the end piece includes successive means for snap-fastening between at least one collar and at least one catch which are situated on the external face of the neck and on the internal face of the skirt;
- the manipulating member is formed of a cap which goes over the neck and is connected to the rest of the bottle by frangible means for tamperproofing and keeping the pushing member in the standby position, it is possible for the cap to be moved axially with respect to the neck after the tamperproofing means have been removed;

- the tamperproofing means have a lip on the inside thereof, the lip interacts with a collar formed on the external surface of the bottle body, and the cap has a similar lip on an interior surface thereof.

BRIEF DESCRIPTION OF THE DRAWINGS

Other features and advantages of the invention will become clear from the following description given by way of a non-limiting example with reference to the attached drawings in which.

DETAILED DESCRIPTION OF THE INVENTION

Figure 1:
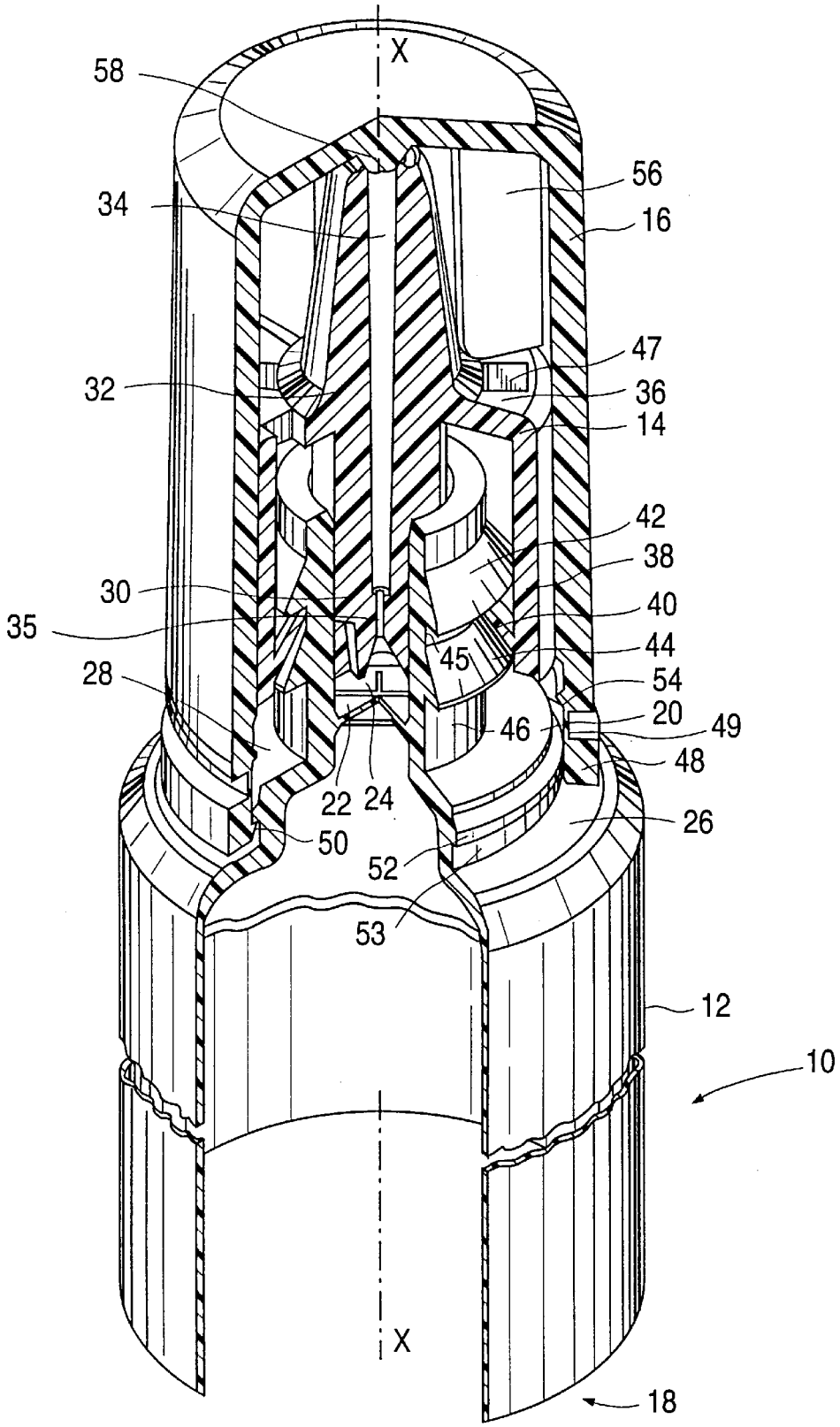
FIG. 1 is a perspective view in partial section of a pre-assembled bottle constructed in accordance with the present invention.

As shown in FIG. 1, a pre-assembled bottle 10 has a hollow body 12, which is intended to received a sterile fluid product. The bottle also includes an end piece 14 and a cap 16. The unit as a whole has an overall axis of symmetry X—X which is assumed to be vertical.

The hollow body 12 has an open lower and rear end 18 to allow it to be filled, and a narrowed upper and front end which forms a neck 20. The end piece 14 is fitted on the upper end of the neck 16 and the cap 16 covers the end piece.

The body 12 furthermore comprises a transverse membrane 22 for hermetically sealing the neck, and the membrane is set back from the outlet orifice of the neck.

Figure 2:
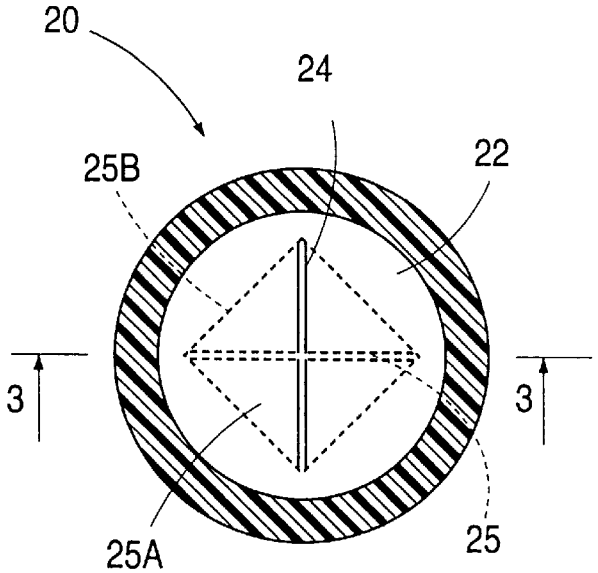
FIG. 2 is a schematic view in transverse section and on a larger scale of the neck of the bottle of FIG. 1.
Figure 3:
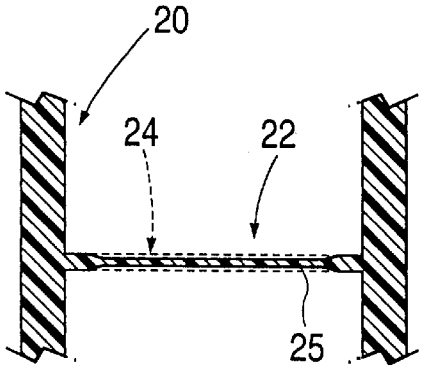
FIG. 3 is a sectional view taken on section line 3—3 of FIG. 2.

Referring to FIGS. 2 and 3 in which some details have been exaggerated for a better understanding, the membrane 22 is relatively thick over most of its surface and has a region 24 of lower mechanical strength for weakening the membrane to make it tearable.

The region 24 of lower mechanical strength has the shape of a star with four points 25, which are uniformly distributed in the z membrane 22 to form a cross. These points are produced by making the corresponding regions of the membrane 22 much thinner.

The points 25 of the weakened star in pairs delimit in the membrane 22 displaceable flaps 25A which increase in width radially towards the periphery of the membrane.

Thus, upon tearing, the membrane has four triangular flaps.

It also has four regions of articulation 25B situated close to the periphery of the membrane 22 and each one corresponding to a region where one of the flaps 25A is articulated. The articulation regions, represented by dotted lines in FIG. 2, connect the radially outermost ends of two consecutive points 25 together in pairs.

Referring again to FIG. 1, the upper end of the body 12 furthermore has an annular seat 26 and a coaxial shoulder 28 which has a smaller diameter relative to the annular seat. The annular seat 26 is intended to receive part of the cap 16, as will be described in detail below.

The bottle 10 furthermore comprises means of piercing the membrane 22. In the embodiment depicted, the piercing means includes a member for pushing the flaps 25A, and the member is formed by the end piece 14 which is fitted into the neck 20.

Figure 4:
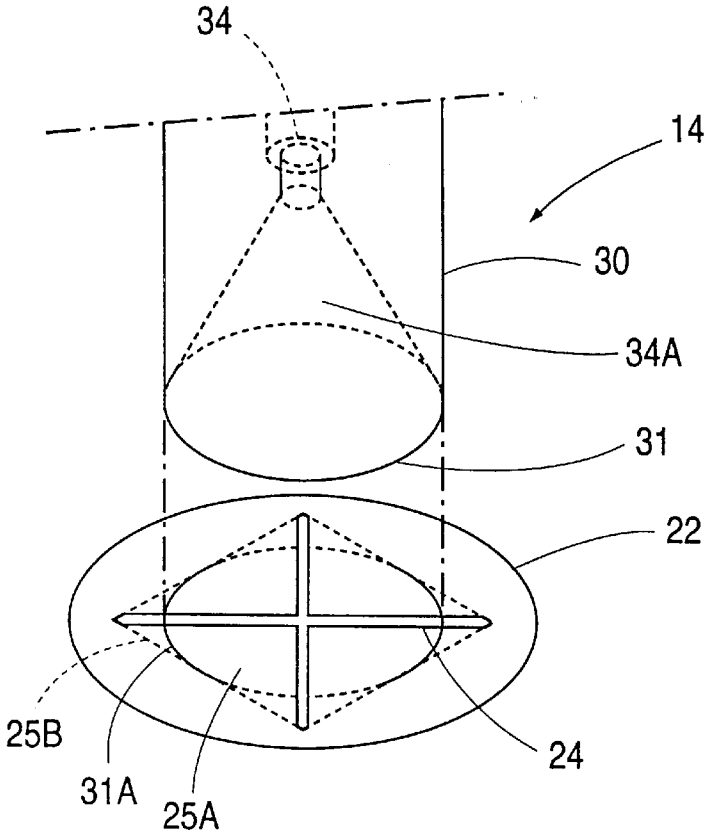
FIG. 4 is a schematic view on a larger scale of part of an end piece and of a membrane of the bottle shown in FIG. 1.

The end piece 14 can be moved axially in the neck 20 between a standby position and an active position for tearing the membrane. The end piece 14 includes a stem 30 for tearing membrane 22 by extending the end piece 14 into the neck 20. As depicted in FIG. 4, the stem 30 comprises a free-end region having a circular cross-section ending in a circular edge 31 forming a circular or annular region that rests against a complementary resting region 31A of the flaps 25A while the membrane 22 is being torn.

The outside diameter of the stem 30 is designed so that the complementary resting region 31A of the flaps 25A intersects the points 25 at their radially outermost part. In the example depicted, this region 31A is approximately tangential to the articulation regions 25B.

The stem 30 is extended downstream, i.e. upwards in FIG. 1, by a tip 32 which emerges out of the body 12. The end piece 14 has a duct 34 passing longitudinally through the end piece to permit the flow of fluid. The duct opens upstream, i.e. downwards in FIG. 1, at the free end of the stem 30, and downstream, at the free end of the tip 32.

The duct 34, close to its upstream end, forms a calibrated orifice 35 which defines the pressure drop across the duct. The orifice 35 is connected to the circular edge 31 by a region 34A, the transverse section of which increases progressively towards the upstream orifice, giving the duct a flared shape.

At its base, the tip 32 has an annular shoulder 36 extended upstream by a skirt 38 surrounding the neck 20.

Furthermore, the bottle 10 has a means for positioning the tearing stem 30 of the end piece 14 in the neck 20 in at least two relative axial positions.

In the embodiment depicted, the positioning means includes successive snap-fastening structures which are formed, of a ring of upwardly inclined catches 40 which project from the internal face of the skirt 38 and, of two axially offset collars 42 and 44 formed on the external surface of the neck 20. Each of the collars 42, 44 delimit an upper snap-fastening ramp for the catches 40 and delimit two respective grooves 45 and 46.

The shoulder 36 further comprises a set of slots 47, which are provided to facilitate mold-release of the catches 40.

As an alternative, it would also be possible to provide the ring of catches on the external surface of the neck and the collars on the internal surface of the skirt. Two rows of catches are also possible, especially when combined with a single snap-fastening collar.

The bottle 10 also comprises a member for manipulating the end piece 14.

The manipulating member includes the cap 16 which goes over the neck 20. The cap 16 has frangible means for tamperproofing the bottle and for keeping the end piece 14 in the standby position. The frangible means are formed of a removable tamperproofing ring 48 formed integrally with the free edge of the cap 16. The connection between the cap 16 and the tamperproofing ring 48 is provided by at least one region 49 which is thinner and tearable so that this ring can be removed.

The ring 48 comprises an internal annular lip 50 which interacts with a snap-fastening collar 52 formed on an external face of the neck 20 so as to define a lower groove 53.

Furthermore, the cap 16 comprises a second annular lip 54 similar to the lip 50 of the ring 48 and intended to interact with the groove 53 of the neck 20. What is more, close to its upper closed-end region of the cap 16, a series of radial ribs 56 form resting surfaces that are intended to interact with the shoulder 36 of the end piece 14, and on the inside of the closed end of the cap 16, a central pip or projection 58 is provided for sealing the downstream orifice of the duct 34 formed in the end piece 14.

During production of the bottle 10, the first step is the production, by injection of a plastic, as a single piece, of the body 12 with its open rear end 18 and its neck 20 sealed by the membrane 22 which is weakened by the star 24 and formed integrally with the neck 20. The end piece 14 and the cap 16 are produced separately by injection molding using a plastic material.

The end piece 14 is then fitted into the neck 20 in such a way that the row of catches 40 snap-fastens below the upper notch 45.

The cap 16 is then fitted forcibly, in a hot state, onto the neck 20 far enough so that the annular lip 50 of the ring 48 is snap-fastened into the groove 53. In this position the cap is immobilized with respect to the body 12. The pre-assembled bottle 10 is now ready to be filled.

To carry out the filling operation, the bottle is inverted and the hollow body 12 is filled via its open rear end 18. The bottom of the bottle 10 is then sealed by pinching the rear end 18 together and welding it. The bottle is thus in the condition depicted in the left-hand half of FIG. 5, in which the end piece 14 is situated in the standby position and the cap is locked on the neck 20.

It should be noted that in this position, the bottle is sealed and the product contained in the hollow body is perfectly protected from any contamination. The pre-assembled bottle can be made sterile so that the risk of contamination during filling is minimized.

The filled bottle is used in the following way.

To remove the cap 16, the user first of all removes the tamperproofing ring 48. The cap is then pressed to make it move into the space which was previously occupied by the ring 48. The annular lip 54 becomes snap-fastened in the groove 53, the end edge of the cap 16 is pressed against the seat 26 of the body 12, and the end edge of the end piece opposes the shoulder 28.

Figure 5:
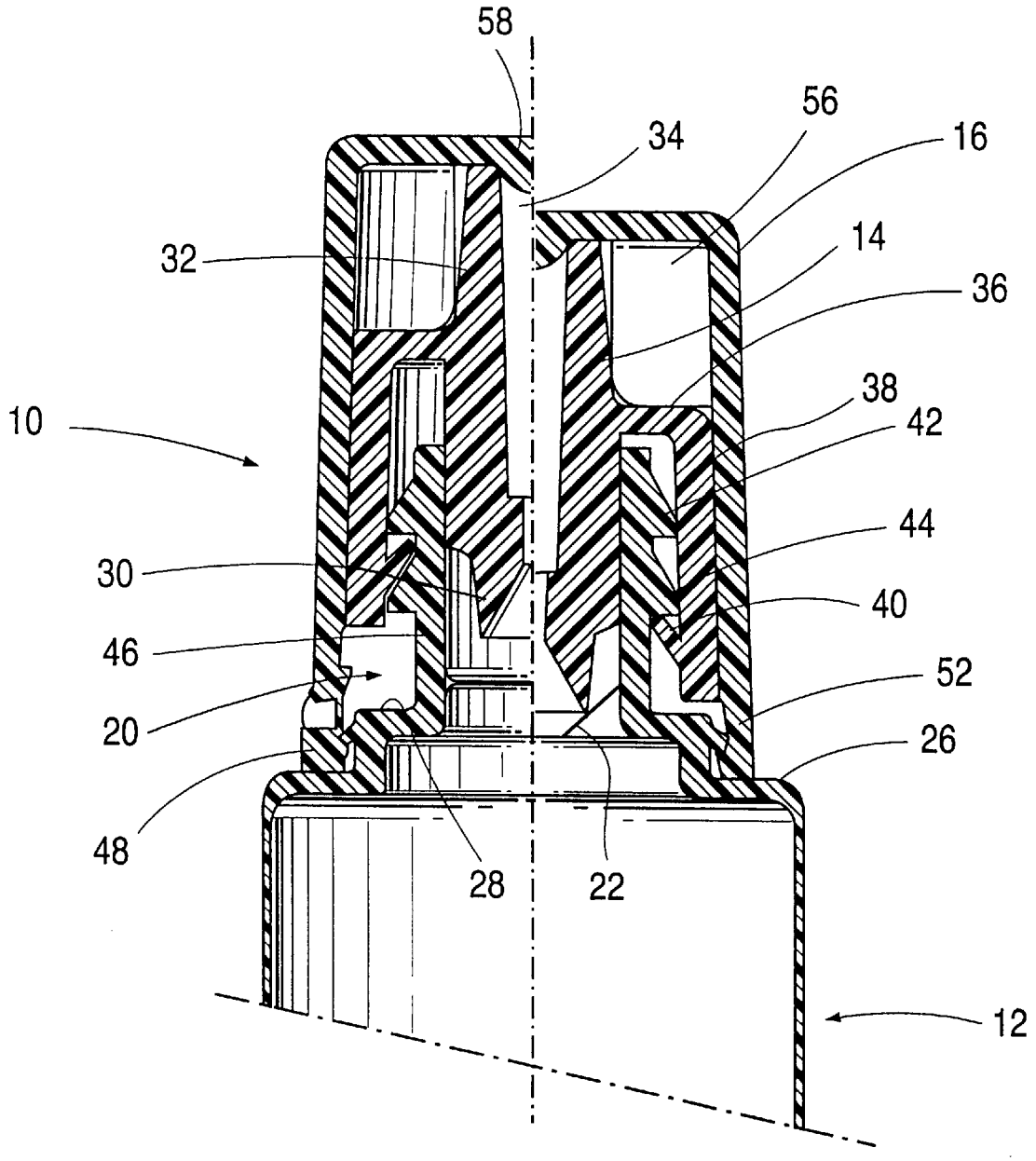
FIG. 5 is a cross sectional view of an axial section of the bottle of FIG. 1 illustrating tearing of the membrane.

During this movement, the radial ribs 56 of the cap come to rest against the shoulder 36 of the end piece 14, and this causes the latter to move from its standby position in which the free end of the tearing stem 30 is situated downstream of, and therefore above, the membrane, into its active position for tearing the membrane 22, as depicted in the right-hand half of FIG. 5. In this position, the row of catches 40 are snap-fastened into the second notch 46 of the neck 20, and the stem 30 is disposed upstream of (below) the periphery of the membrane.

The membrane lies in the path of the end of the stem 30. Thus, as it moves, the stem 30 causes the points 25 of the membrane 22 to rupture as the edge 31 rests on a region of the flap which is next to the articulation regions 25B, thereby causing the flaps 25A to fold back about their articulation region 25B and causing the membrane 22 to open. From this moment on, the inside of the body 12 can communicate with the upstream orifice of the fluid flow duct 34.

The configuration of the membrane 22 and of the stem 30 makes it possible to limit the travel of the end piece 14 needed for reliably tearing the membrane.

The body 12 of the bottle 10 has a structure which is radially deformable to make it easier to dispense the product, and the configuration of the fluid flow duct 34 is specially designed to allow the product to be dispensed one drop at a time.

It should be noted that so long as the cap 16 is over the neck 20, the central pip or projection 58 seals the downstream orifice of the fluid flow duct 34 in order to prevent any leakage of fluid contained in the body 12, and to prevent any contamination of the liquid when the membrane 22 has been torn.

As an alternative, the base of the cap 16 may be shaped in such a way as to screw onto a screw thread provided on the external surface of the body 12. The membrane would then be pierced by taking hold of the cap and twisting it.

The invention is not restricted to the embodiments described.

Thus the membrane may just as easily have a thinned region of lower mechanical strength which forms different geometric shapes, for example a circular shape with a diameter slightly larger than that of the edge 31.

It is also the case that the membrane may just as easily be situated at any point below the end edge of the neck.

I claim:

1. A bottle comprising:

a hollow body for containing a product, said hollow body having an end forming a neck, a tearable transverse membrane sealing said neck, and means for tearing said membrane, said tearing means being movable axially in said neck; and a manipulating member for moving said tearing means between a standby position and an active position in order to tear said membrane, wherein said membrane has a weakened region delimiting in said membrane at least one displaceable flap, and a flap-articulation region between at least two radially outermost ends of said weakened region, wherein said tearing means includes a pushing member for pushing said at least one displaceable flap by resting against a region of said flap that is close to said flap-articulation region, wherein said pushing member comprises:

an end piece mounted on a free end of said neck, said end piece including an axial skirt surrounding said neck and a stem extending into said neck, said stem having a lower end defining an annular edge for tearing said membrane; and a fluid flow duct passing longitudinally through said end piece for permitting the fluid product to flow therethrough, wherein said body and said end piece comprise successive means for snap-fastening between at least one collar provided on one of an external face of said neck and an internal face of said skirt, and at least one catch provided on the other of the external face of said neck and on the internal face of said skirt.

2. A bottle as claimed in claim 1, wherein said weakened region is in the shape of a star, and said star delimits a plurality of said displaceable flaps, and the width of each flap increases radially towards a periphery of said membrane.

3. A bottle as claimed in claim 1, wherein said fluid flow duct includes a lower region, in said stem, which has a cross section, relative to a longitudinal axis of said stem, that progressively increases in area in a direction towards said annular edge.

4. A bottle as claimed in claim 1, wherein said manipulating member comprises a cap disposed over said neck and connected to said hollow body by frangible means for tamperproofing and for keeping said pushing member in the standby position such that, upon removal of said tamperproofing means, said cap can be moved axially with respect to said neck.

5. A bottle as claimed in claim 4, further comprising a first lip formed on an internal surface of said cap, and a collar formed on an external surface of said hollow body, wherein said tamperproofing means includes a second lip extending toward said hollow body for interacting with said collar formed on the external surface of said hollow body.

* * * * *